US011632830B2

(12) United States Patent
Malhotra

(10) Patent No.: US 11,632,830 B2
(45) Date of Patent: Apr. 18, 2023

(54) SYSTEM AND METHOD FOR TRANSISTOR PARAMETER ESTIMATION

(71) Applicant: Samsung Display Co., Ltd., Yongin-si (KR)

(72) Inventor: Gaurav Malhotra, Cupertino, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/070,842

(22) Filed: Oct. 14, 2020

(65) Prior Publication Data

US 2022/0046770 A1 Feb. 10, 2022

Related U.S. Application Data

(60) Provisional application No. 63/062,898, filed on Aug. 7, 2020.

(51) Int. Cl.
*H05B 45/10* (2020.01)
*H05B 45/20* (2020.01)
*H05B 45/37* (2020.01)

(52) U.S. Cl.
CPC ..... *H05B 45/10* (2020.01); *H05B 45/20* (2020.01); *H05B 45/37* (2020.01)

(58) Field of Classification Search
CPC ..... H05B 45/10; H05B 45/20; H05B 45/37
See application file for complete search history.

(56) References Cited

U.S. PATENT DOCUMENTS

| | | | | |
|---|---|---|---|---|
| 7,696,773 | B2 | 4/2010 | Levey | |
| 8,184,224 | B2 | 5/2012 | Asano et al. | |
| 8,274,452 | B2 | 9/2012 | Kim | |
| 9,721,502 | B2 | 8/2017 | Bi et al. | |
| 10,499,029 | B2 | 12/2019 | Wang et al. | |
| 10,560,676 | B2 | 2/2020 | Holub | |
| 2006/0017669 | A1 | 1/2006 | Cok et al. | |
| 2010/0053233 | A1* | 3/2010 | Ishiguro | G09G 3/30 345/690 |
| 2011/0191042 | A1* | 8/2011 | Chaji | G09G 3/006 702/64 |
| 2014/0306868 | A1* | 10/2014 | Chaji | G09G 3/006 345/77 |
| 2016/0165700 | A1* | 6/2016 | Takahashi | H05B 45/20 315/158 |
| 2016/0307498 | A1* | 10/2016 | Chaji | G09G 3/3291 |
| 2017/0039953 | A1 | 2/2017 | Lee | |

(Continued)

FOREIGN PATENT DOCUMENTS

EP 3779951 A1 2/2021

*Primary Examiner* — Minh D A

(74) *Attorney, Agent, or Firm* — Lewis Roca Rothgerber Christie LLP

(57) ABSTRACT

A system and method for setting one or more compensation coefficients for a transistor. In some embodiments, a method for setting a first compensation coefficient for a transistor includes: determining a plurality of measured transistor currents, each at a respective one of a plurality of transistor control voltages; setting the first compensation coefficient based on the measured transistor currents and the transistor control voltages; and adjusting a voltage applied to a gate of the transistor based on the first compensation coefficient, the voltage corresponding to a color value.

18 Claims, 3 Drawing Sheets

(56) References Cited

U.S. PATENT DOCUMENTS

| | | | | |
|---|---|---|---|---|
| 2018/0182303 | A1 | 6/2018 | Jung et al. | |
| 2018/0366061 | A1* | 12/2018 | Furukawa | G09G 3/20 |
| 2019/0057633 | A1* | 2/2019 | Li | G09G 3/3225 |
| 2020/0211463 | A1* | 7/2020 | Yue | G09G 3/3233 |
| 2021/0049963 | A1* | 2/2021 | Amirkhany | G09G 3/3258 |

* cited by examiner

SYSTEM AND METHOD FOR TRANSISTOR PARAMETER ESTIMATION

CROSS-REFERENCE TO RELATED APPLICATION(S)

The present application claims priority to and the benefit of U.S. Provisional Application No. 63/062,898 filed Aug. 7, 2020, entitled "PARAMETER ESTIMATION VIA REDUCTION IN DIMENSIONALITY OF VARIABLE SPACE AND THEREBY CALCULATING INITIAL CONDITIONS FOR ADAPTATION", the entire content of which is incorporated herein by reference.

FIELD

One or more aspects of embodiments according to the present disclosure relate to transistor drive circuits, and more particularly to a system and method for transistor parameter estimation.

BACKGROUND

In a system including a transistor having uncertain parameters, or in a system including a plurality of transistors having different parameters, it may be advantageous to drive the transistor or the transistors with a circuit that compensates for the uncertainty in, of for the variation in, the parameters. To this end, a system and method for transistor parameter estimation may be used.

SUMMARY

According to an embodiment of the present invention, there is provided a method for setting a first compensation coefficient for a transistor, the method including: determining a plurality of measured transistor currents, each at a respective one of a plurality of transistor control voltages; setting the first compensation coefficient based on the measured transistor currents and the transistor control voltages; and adjusting a voltage applied to a gate of the transistor based on the first compensation coefficient, the voltage corresponding to a color value.

In some embodiments: the first compensation coefficient is a multiplicative compensation coefficient; the method further includes setting an additive compensation coefficient; and the setting of the multiplicative compensation coefficient and the additive compensation coefficient includes estimating a plurality of parameters of the transistor.

In some embodiments, the plurality of parameters includes an alpha, a threshold voltage, and a mobility.

In some embodiments, the estimating of the plurality of parameters of the transistor includes solving two equations for two parameters, the two parameters being the alpha and the threshold voltage.

In some embodiments, each of the two equations depends only, of the parameters of the transistor, on the alpha and the threshold voltage.

In some embodiments, $$\frac{(Vgs_4 - V_{th})^\alpha - (Vgs_2 - V_{th})^\alpha}{(Vgs_2 - V_{th})^\alpha - (Vgs_1 - V_{th})^\alpha}$$

has a value within 50% of $$\frac{I_4 - I_2}{I_2 - I_1}$$

wherein: $I_1$ is a first current of the plurality of measured transistor currents, $I_2$ is a second current of the plurality of measured transistor currents, $I_3$ is a third current of the plurality of measured transistor currents, $I_4$ is a fourth current of the plurality of measured transistor currents, $Vgs_1$ is a transistor control voltage, of the plurality of transistor control voltages, corresponding to the first current, $Vgs_2$ is a transistor control voltage, of the plurality of transistor control voltages, corresponding to the second current, $Vgs_3$ is a transistor control voltage, of the plurality of transistor control voltages, corresponding to the third current, $Vgs_4$ is a transistor control voltage, of the plurality of transistor control voltages, corresponding to the fourth current, $V_{th}$ is the threshold voltage, and $\alpha$ is the alpha.

In some embodiments, $$\frac{(Vgs_2 - V_{th})^\alpha}{(Vgs_1 - V_{th})^\alpha}$$

has a value within 50% of $$\frac{I_2}{I_1}$$

wherein: $I_1$ is a first current of the plurality of measured transistor currents, $I_2$ is a second current of the plurality of measured transistor currents, $Vgs_1$ is a transistor control voltage, of the plurality of transistor control voltages, corresponding to the first current, $Vgs_2$ is a transistor control voltage, of the plurality of transistor control voltages, corresponding to the second current, $V_{th}$ is the threshold voltage, and $\alpha$ is the alpha.

In some embodiments, the solving includes finding an approximate numerical solution for the alpha and the threshold voltage, the approximate numerical solution minimizing a measure of error in the extent to which the two equations are satisfied.

In some embodiments, the method further includes solving for the mobility with a least squares fit, based on the alpha and the threshold voltage.

In some embodiments, the parameters further include a bias current.

In some embodiments, the method further includes solving for the bias current with a least squares fit, based on the alpha, the threshold voltage, and the mobility.

In some embodiments, the estimating of the plurality of parameters of the transistor includes solving one equation for the threshold voltage, wherein the equation depends only, of the parameters of the transistor, on the threshold voltage.

In some embodiments, $$\frac{\log\left[\frac{(Vgs_4 - V_{th})}{(Vgs_3 - V_{th})}\right]}{\log\left[\frac{(Vgs_2 - V_{th})}{(Vgs_1 - V_{th})}\right]}$$

has a value within 50% of $$\frac{\log\left[\frac{I_4}{I_3}\right]}{\log\left[\frac{1I_2}{I_1}\right]}$$

wherein: $I_1$ is a first current of the plurality of measured transistor currents, $I_2$ is a second current of the plurality of measured transistor currents, $I_3$ is a third current of the plurality of measured transistor currents, $I_4$ is a fourth current of the plurality of measured transistor currents, $Vgs_1$ is a transistor control voltage, of the plurality of transistor control voltages, corresponding to the first current, $Vgs_2$ is a transistor control voltage, of the plurality of transistor control voltages, corresponding to the second current, $Vgs_3$ is a transistor control voltage, of the plurality of transistor control voltages, corresponding to the third current, $Vgs_4$ is a transistor control voltage, of the plurality of transistor control voltages, corresponding to the fourth current, and $V_{th}$ is the threshold voltage.

In some embodiments, the method further includes setting the additive compensation coefficient to a value within 20% of a value corresponding to an effective threshold voltage of zero.

In some embodiments, the method further includes setting the multiplicative compensation coefficient to a value within 20% of a value corresponding to an effective mobility equal to a reference mobility.

In some embodiments, the first compensation coefficient is a multiplicative compensation coefficient, and the method further includes: setting an additive compensation coefficient; setting the voltage applied to the gate based on: the multiplicative compensation coefficient, the additive compensation coefficient, and the color value, measuring a difference between: a current driven by the transistor, and a reference current; and adjusting the multiplicative compensation coefficient and the additive compensation coefficient based on the difference.

According to an embodiment of the present invention, there is provided a system including: a processing circuit; a power source; a light emitting device; and a transistor, connected between a power source and the light emitting device, the processing circuit being configured to: determine a plurality of measured transistor currents, each at a respective one of a plurality of transistor control voltages; and set a first compensation coefficient based on the measured transistor currents and the transistor control voltages.

In some embodiments: the first compensation coefficient is a multiplicative compensation coefficient; the processing circuit is further configured to set an additive compensation coefficient; the setting of the multiplicative compensation coefficient and the additive compensation coefficient includes estimating a plurality of parameters of the transistor; and the parameters include an alpha, a threshold voltage, and a mobility.

In some embodiments, the estimating of the plurality of parameters of the transistor includes solving two equations for two parameters, the two parameters being the alpha and the threshold voltage, wherein each of the two equations depends only, of the parameters of the transistor, on the alpha and the threshold voltage.

According to an embodiment of the present invention, there is provided a system including: means for processing; a power source; a light emitting device; and a transistor, connected between a power source and the light emitting device, the means for processing being configured to: determine a plurality of measured transistor currents, each at a respective one of a plurality of transistor control voltages; and set a first compensation coefficient based on the measured transistor currents and the transistor control voltages.

BRIEF DESCRIPTION OF THE DRAWINGS

These and other features and advantages of the present disclosure will be appreciated and understood with reference to the specification, claims, and appended drawings wherein:

DETAILED DESCRIPTION

The detailed description set forth below in connection with the appended drawings is intended as a description of exemplary embodiments of a system and method for transistor parameter estimation provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Figure 1:
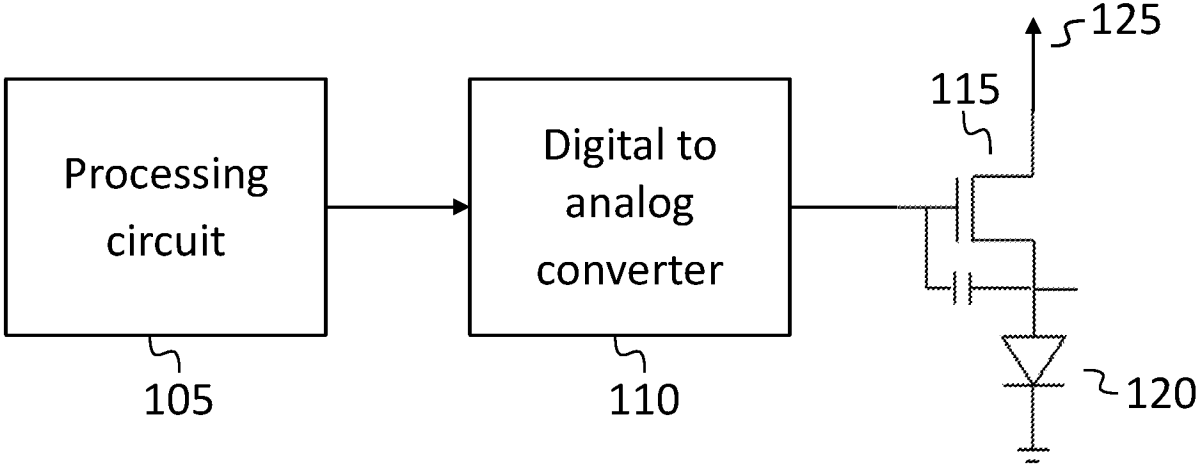
FIG. 1 is a block diagram of a circuit with a transistor, according to an embodiment of the present disclosure.

Referring to FIG. 1, in a video display, such as a computer monitor, a plurality of light emitting pixels may each include a drive transistor 115, the drive transistor 115 being configured to drive a current through a light-emitting device, such as a light emitting diode 120, responsive to a brightness control signal, or "color value". The drive transistor 115 may be a field-effect transistor (FET) connected to a power source 125. A display may include a large number of such drive transistors, and the drive transistors may not be perfectly identical. In such a system (and in other systems in which a transistor is to be controlled) it may be advantageous to compensate for the variations in transistor parameters so that a given brightness control signal (e.g., a digital control signal received from a video card of a computer), specifying a brightness to be achieved, results in substantially the same brightness, regardless of which pixel it is applied to.

In such a system, parameters may be estimated for each transistor, and a control voltage may be applied to each transistor based on the brightness control signal and on the parameters of the transistor. The control voltage may be adjusted (e.g., by a processing circuit 105 (discussed in further detail below), and a digital to analog converter 110) to compensate for differences between the parameters of the transistor being driven and a reference transistor. For example, a multiplicative compensation coefficient may be applied to (i.e., multiplied by) the brightness control signal, and an additive compensation coefficient may then be applied to the product (of the brightness control signal and the multiplicative compensation coefficient), such that the transistor drives substantially the same current as a reference transistor (which may be a hypothetical, "ideal" transistor) would drive for the same brightness control signal, if the compensation coefficients (i.e., the multiplicative compensation coefficient and the additive compensation coefficient) were set to nominal values.

The parameters of the transistor may be estimated by measuring the current that the transistor drives (i.e., determining a measured transistor current) at each of a plurality of transistor control voltages. As used herein, the "current that the transistor drives" is the current flowing through the channel of the transistor (i.e., between the source and the drain). As used herein, the "control voltage" or "transistor control voltage" is the gate-source voltage.

From the measured transistor currents and the transistor control voltages, parameters of the transistor may be estimated, and, based on these parameters, initial values of the compensation coefficients (i.e., the multiplicative compensation coefficient and the additive compensation coefficient) may be set. These parameters may include, for a FET, the threshold voltage $V_{th}$, the mobility M, the alpha α, and the bias current $I_{bias}$. The transistor model parameterized by these parameters may be:

$$I_{DS}=M*(V_{gs}-V_{th})^{\alpha}+I_{bias}$$

The terms "alpha" and "α" are synonymous, and used interchangeably, herein.

In some embodiments, the parameters may be estimated as follows, from a plurality of measured transistor currents, each determined at a respective one of a plurality of transistor control voltages. Four of the measured transistor currents may be referred to as $I_1$, $I_2$, $I_3$, and $I_4$, and the corresponding control voltages may be $Vgs_1$, $Vgs_2$, $Vgs_3$, and $Vgs_4$. These measured transistor currents and transistor control voltages result, when substituted into the transistor model, in the following four equations:

$$I_1=(Vgs_1-V_{th})^{\alpha}*M+I_{bias}$$

$$I_2=(Vgs_2-V_{th})^{\alpha}*M+I_{bias}$$

$$I_3=(Vgs_3-V_{th})^{\alpha}*M+I_{bias}$$

$$I_4=(Vgs_4-V_{th})^{\alpha}*M+I_{bias}$$

These equations may be combined (e.g., subtracted) pairwise, to arrive at, for example, the following three equations, from which the bias term $I_{bias}$ has been eliminated:

$$I_2-I_1=M*[(Vgs_2-V_{th})^{\alpha}-(Vgs_1-V_{th})^{\alpha}]$$

$$I_4-I_2=M*[(Vgs_4-V_{th})^{\alpha}-(Vgs_2-V_{th})^{\alpha}]$$

$$I_4-I_3=M*[(Vgs_4-V_{th})^{\alpha}-(Vgs_3-V_{th})^{\alpha}]$$

The above three equations are three of the six (three choose two) such equations that may be formed as pairwise differences of the four measured transistor currents. In some embodiments, more than four transistor currents are measured (or fewer may be measured, as discussed below), and a different set of pairwise differences may be formed. The three equations above may be combined (e.g., ratios may be taken) pairwise, to arrive at, for example, the following two equations, from which the mobility M has also been eliminated:

$$\frac{I_4-I_2}{I_2-I_1}=\frac{(Vgs_4-V_{th})^{\alpha}-(Vgs_2-V_{th})^{\alpha}}{(Vgs_2-V_{th})^{\alpha}-(Vgs_1-V_{th})^{\alpha}}$$

-continued $$\frac{I_4-I_2}{I_3-I_1}=\frac{(Vgs_4-V_{th})^{\alpha}-(Vgs_2-V_{th})^{\alpha}}{(Vgs_3-V_{th})^{\alpha}-(Vgs_1-V_{th})^{\alpha}}$$

As such, each of the two equations depends only, of the parameters of the transistor, on the alpha and the threshold voltage. The above equations are two independent equations in the two unknowns, and may be solved for the unknowns, $V_{th}$ and α. This may be accomplished, for example, by performing a gradient descent optimization or by performing an exhaustive search across a grid of values of $V_{th}$ and α, the grid extending over a respective range of plausible values for each of $V_{th}$ and α (e.g., a range of 0V to 0.7V for $V_{th}$, and a range of 1.5 to 2.5 for α), to find a set of {$V_{th}$, α} values that minimize a cost function. Such an approach may find an approximate numerical solution for the alpha and the threshold voltage, the approximate numerical solution minimizing the cost function, which may be a measure of error in the extent to which the two equations are satisfied. The cost function may be the mean squared error, for example, defined as follows:

$$MSE=\sqrt{\sum_{i=1}^{N}\frac{(LHS(i)-RHS(i))2}{N}}.$$

The values for $V_{th}$ and α may satisfy the above equations, e.g., for these values of $V_{th}$ and α, it may be the case that $$\frac{(Vgs_4-V_{th})^{\alpha}-(Vgs_2-V_{th})^{\alpha}}{(Vgs_2-V_{th})^{\alpha}-(Vgs_1-V_{th})^{\alpha}}$$

has the same value as $$\frac{I_4-I_2}{I_2-I_1},$$

or, in some embodiments, the values may differ somewhat, e.g., $$\frac{(Vgs_4-V_{th})^{\alpha}-(Vgs_2-V_{th})^{\alpha}}{(Vgs_2-V_{th})^{\alpha}-(Vgs_1-V_{th})^{\alpha}}$$

may have a value within 50% of $$\frac{I_4-I_2}{I_2-I_1}.$$

Once values for $V_{th}$ and α have been found, a value for the mobility M may be found from the following equations (which are three equations in the one unknown M).

$$I_2-I_1=M*[(Vgs_2-V_{th})^{\alpha}-(Vgs_1-V_{th})^{\alpha}]$$

$$I_4-I_2=M*[(Vgs_4-V_{th})^{\alpha}-(Vgs_2-V_{th})^{\alpha}]$$

$$I_4-I_3=M*[(Vgs_4-V_{th})^{\alpha}-(Vgs_3-V_{th})^{\alpha}]$$

These equations form an overdetermined system of linear equations and may be solved, e.g., by writing them in the following form:

$$M * \begin{bmatrix} k1 \\ k2 \\ k3 \end{bmatrix} = \begin{bmatrix} I_2 - I_1 \\ I_4 - I_2 \\ I_4 - I_3 \end{bmatrix}$$

where $k1=[(Vgs_2-V_{th})^{\alpha}-(Vgs_1-V_{th})^{\alpha}]$, and k2 and k2 are defined analogously, and solving $$M=K^{\psi}I$$

where $K^{\psi}$ is the pseudoinverse of the vector $$\begin{bmatrix} k1 \\ k2 \\ k3 \end{bmatrix}$$

and I is the vector $$\begin{bmatrix} I_2 - I_1 \\ I_4 - I_2 \\ I_4 - I_3 \end{bmatrix}.$$

To find the bias, the following overdetermined system may be solved for $I_{bias}$:

$$I_{bias} = \begin{bmatrix} 1 \\ 1 \\ 1 \\ 1 \end{bmatrix} = \begin{bmatrix} I_1 \\ I_2 \\ I_3 \\ I_4 \end{bmatrix} - \begin{bmatrix} M*(Vgs_1 - V_{th})^{\alpha} \\ M*(Vgs_2 - V_{th})^{\alpha} \\ M*(Vgs_3 - V_{th})^{\alpha} \\ M*(Vgs_4 - V_{th})^{\alpha} \end{bmatrix}$$

If a least squares fit is used to solve this system, the solution for $I_{bias}$ will be the mean of the four bias currents (which may be obtained by solving the transistor model for the bias current four times, using, each time, (i) a different one of the four measured transistor currents and (ii) the corresponding transistor control voltage).

In some circumstances, the leakage current $I_{bias}$ may be negligible (e.g., there may be no leakage). The zero-bias transistor model may be written:

$$I_{DS}=M*(V_{gs}-V_{th})^{\alpha}$$

In this model, $\alpha$, $V_{th}$, and M are the unknown parameters to be estimated. The mobility may be eliminated by taking a ratio of (i) the zero-bias transistor model at a second measured transistor current and at the corresponding transistor control voltage and (ii) the zero-bias transistor model at a first measured transistor current and at the corresponding transistor control voltage:

$$\frac{I_2}{I_1} = \frac{M(Vgs_2 - V_{th})^{\alpha}}{M(Vgs_1 - V_{th})^{\alpha}}.$$

From this equation, it follows that $$\frac{I_2}{I_1} = \frac{(Vgs_2 - V_{th})^{\alpha}}{(Vgs_1 - V_{th})^{\alpha}}$$

which is an equation in the unknowns $V_{th}$ and $\alpha$. Another equation in the unknowns $V_{th}$ and $\alpha$ may be obtained for additional measured transistor currents and corresponding transistor control voltages:

$$\frac{I_4}{I_3} = \frac{(Vgs_2 - V_{th})^{\alpha}}{(Vgs_3 - V_{th})^{\alpha}}$$

Each of the two equations above depends only, of the parameters of the transistor, on the alpha and the threshold voltage. Taking the logarithm of both sides of each of two equations above the results in the following equations:

$$\log\left[\frac{I_2}{I_1}\right] = \alpha\log\left[\frac{(Vgs_2 - V_{th})}{(Vgs_1 - V_{th})}\right]$$

$$\log\left[\frac{I_4}{I_3}\right] = \alpha\log\left[\frac{(Vgs_4 - V_{th})}{(Vgs_3 - V_{th})}\right]$$

The parameter $\alpha$ may then be eliminated by taking the ratio of the above equations:

$$\frac{\log\left[\frac{I_4}{I_3}\right]}{\log\left[\frac{I_2}{I_1}\right]} = \frac{\log\left[\frac{(Vgs_4 - V_{th})}{(Vgs_3 - V_{th})}\right]}{\log\left[\frac{(Vgs_2 - V_{th})}{(Vgs_1 - V_{th})}\right]}$$

The above equation depends only, of the parameters of the transistor, on the threshold voltage, and may be solved iteratively for $V_{th}$ (e.g., by performing an exhaustive search across a grid of values of $V_{th}$, the grid extending over a range of plausible values of $V_{th}$ (e.g., a range of 0 to 0.7V)). In some embodiments, the transistor control voltages are chosen such that $$\frac{I_4}{I_3} = \frac{I_2}{I_1}$$

(e.g., the currents may be (or may be within 30% of) the following: $I_1$=1 nA, $I_2$=2 nA, $I_3$=2.5 nA, and $I_4$=5 nA), in which case $V_{th}$ may be solved for directly, to arrive at the following:

$$V_{th} = \frac{Vgs_1 Vgs_4 - Vgs_3 Vgs_2}{Vgs_1 + Vgs_4 - Vgs_3 - Vgs_2}$$

In some embodiments, a similar (but not necessarily identical) value for $V_{th}$ may be found, e.g., one for which $$\frac{\log\left[\frac{(Vgs_4 - V_{th})}{(Vgs_3 - V_{th})}\right]}{\log\left[\frac{(Vgs_2 - V_{th})}{(Vgs_1 - V_{th})}\right]}$$

has a value within 50% of $$\frac{\log\left[\frac{I_4}{I_3}\right]}{\log\left[\frac{I_2}{I_1}\right]}.$$

The value of $V_{th}$ may then be used to find α and M as follows:

$$\alpha = \frac{\mathrm{Log}(I_2/I_1)}{\mathrm{Log}[(Vgs_2 - V_{th})/(Vgs_1 - V_{th})]}$$

$$M = \frac{I_2}{(V_2 - Vth)^{\alpha}}$$

These values of $V_{th}$ and α may have the characteristic that $$\frac{(Vgs_2 - V_{th})^{\alpha}}{(Vgs_1 - V_{th})^{\alpha}}$$

has a value within 50% of $$\frac{I_2}{I_1}.$$

Since α and M can be calculated using multiple values of the measured transistor currents and the corresponding transistor control voltages, a least squares fit may be used to calculate alpha:

$$\alpha = \mathrm{Log}\ V^{\psi}\ \mathrm{Log}\ I \text{ or } \alpha = (\mathrm{Log}(V))^{\psi}\ \mathrm{Log}\ I$$

Then α and M may be obtained as follows:

$$\alpha = \log\left[\frac{I_2}{I_1}\right] \Big/ \log\left[\frac{(Vgs_2 - V_{th})}{(Vgs_1 - V_{th})}\right]$$

$$M = I_2/(Vgs_2 - V_{th})^{\alpha}$$

The above approach uses four measured transistor currents; because, in the zero-bias case, only three parameters ($V_{th}$, α and M) are solved for, three measured transistor currents may be sufficient to solve for these parameters, and, in some embodiments, only three measured transistor currents are used.

Figure 2:
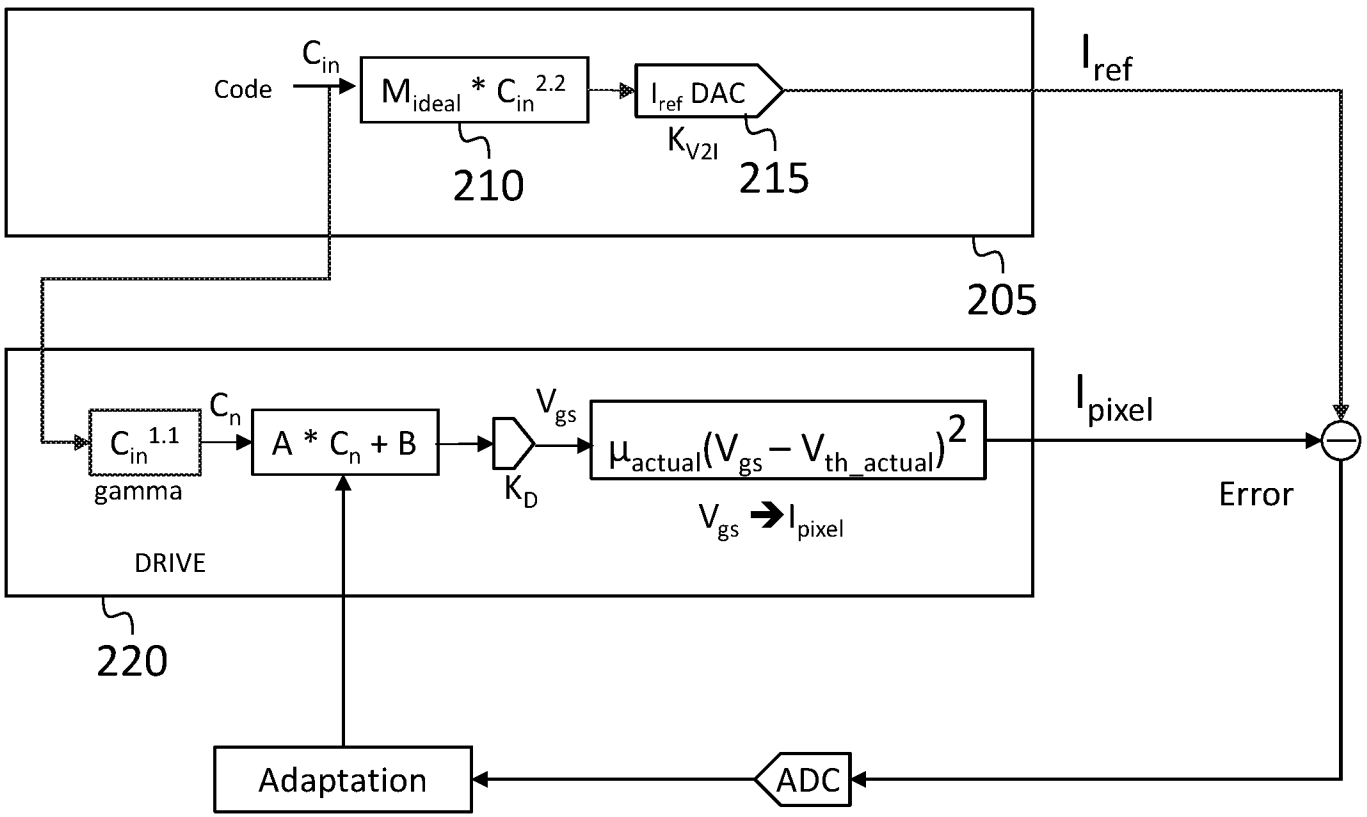
FIG. 2 is a block diagram of a circuit with a transistor, according to an embodiment of the present disclosure.

Once the parameters of the transistor have been estimated, compensation coefficients (i.e., the multiplicative compensation coefficient and the additive compensation coefficient) may be calculated as follows. FIG. 2 shows a circuit for controlling a transistor, in some embodiments. A reference current source 205 includes (i) a processing circuit for calculating $M_{ideal}*C_{in}^2$, OK where $M_{ideal}$ is a reference mobility and $C_{in}$ is a control word (which may represent a requested pixel brightness) and (ii) a current digital to analog converter (or "current DAC") 215, and produces a reference current, according to the function $I_{ref}=M_{ideal}\ K_{V2I}\ C_{in}^2$. The reference mobility $M_{ideal}$ may be selected to be within the range of plausible values for M, e.g., it may be selected to be a value the mobility would be expected to have, absent manufacturing variations and changes in transistor characteristics with age. A drive circuit 220 includes the processing circuit 105 (FIG. 1) (which calculates an adjusted transistor control voltage based on the control word $C_{in}$ and on the compensation coefficients), the digital to analog converter 110, and the transistor 115. The processing circuit 105, which is employed for applying the compensation (i.e., the multiplicative compensation coefficient and the additive compensation coefficient) may be a processing circuit, suitably configured (e.g., with firmware or software) and may be referred to as a "compensation circuit". The processing circuit 105 of the drive circuit may share components with (e.g., it may be the same processing circuit as) the processing circuit 210 of the reference current source 205. The reference mobility $M_{ideal}$, the gain $K_{V2I}$ of $I_{ref}$ DAC, and the gain $K_D$ of the digital to analog converter of the drive circuit 220 are known.

The unknown parameters include $V_{th}$ (which may also be referred to as $V_{th_actual}$), the actual threshold voltage of the transistor, and M (which may also be referred to as $M_{actual}$), the actual mobility of the transistor. These unknown parameters may be estimated, e.g., as described above, from measured transistor currents and from the corresponding transistor control voltages.

Initial values of the compensation coefficients (i.e., the multiplicative compensation coefficient A and the additive compensation coefficient B) may then be calculated as follows.

If $I_{ref}=I_{pixel}$, then $$M_{ideal}[K_{V2I}C_n^{2.2}]=M_{actual}[K_D(AC_n^{1.1}+B)-V_{th_actual}]^2$$

$$M_{ideal}\ K_{V2I}C_n^{2.2}=M_{actual}[K_DAC_n^{1.1}+K_DB-V_{th_actual}]^2$$

If B is chosen such that $K_DB=V_{th_actual}$, (by setting $B=V_{th_actual}/K_D$ then the equation above becomes $$M_{ideal}\ K_{V2I}C_n^{2.2}=M_{actual}[K_DAC_n^{1.1}]^2$$

which may be solved for A to yield $$A=\sqrt{(M_{ideal}/M_{actual})}*(1/K_D)$$

The combination of the compensation circuit 105, the digital to analog converter 110, and the transistor 115 may, when the above values of A and B are used, have characteristics that are substantially those of an uncompensated transistor having a threshold voltage of zero, and having the reference mobility, driven through a digital to analog converter 110 with the same gain. As such, the above values of A and B correspond to an effective threshold voltage of zero and to an effective mobility equal to a reference mobility. The above-derived values of A and B may be used as initial values, and adaptive adjustments may then be made, based on residual errors (each residual error being a measured difference between (i) a desired, or "reference" current to be driven through a light-emitting device, and (ii) a transistor drive current) measured when the compensation coefficients (i.e., the multiplicative compensation coefficient and the additive compensation coefficient) are applied. The adaptation may be performed, for example, as described in U.S. patent application Ser. No. 16/657,680, filed Oct. 18, 2019, entitled "ESTIMATION OF PIXEL COMPENSATION COEFFICIENTS BY ADAPTATION", which is incorporated herein by reference.

Figure 3:
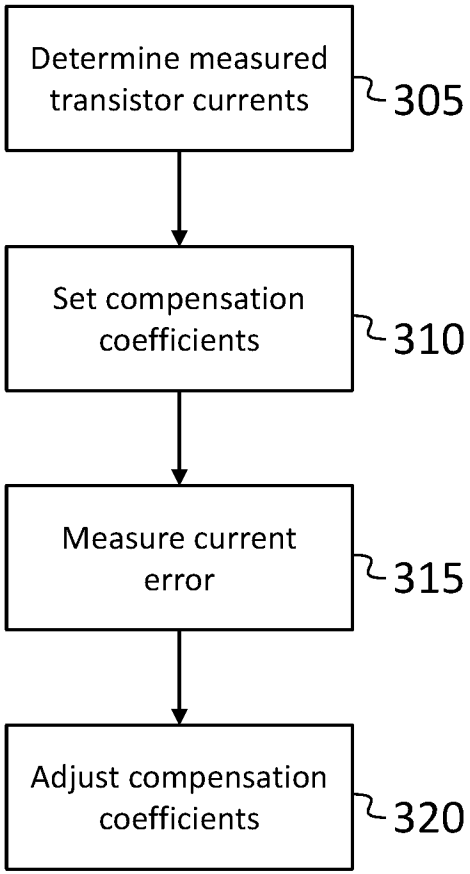
FIG. 3 is a flow chart of a method for transistor parameter estimation and compensation, according to an embodiment of the present disclosure.

FIG. 3 shows a flow chart, in some embodiments. The method includes, at 305, determining a plurality of measured transistor currents (e.g., each at a respective one of a plurality of transistor control voltages); at 310, setting initial values for the multiplicative compensation coefficient and the additive compensation coefficient (e.g., based on the current measurements and the control voltages); and performing adaptive adjustments of the multiplicative compensation coefficient and the additive compensation coefficient, e.g., by, at 315, measuring a residual error; and, at 320, adjusting the multiplicative compensation coefficient and the additive compensation coefficient.

As used herein, "a portion of" something means "at least some of" the thing, and as such may mean less than all of, or all of, the thing. As such, "a portion of" a thing includes the entire thing as a special case, i.e., the entire thing is an example of a portion of the thing. As used herein, the term "rectangle" includes a square as a special case, i.e., a square is an example of a rectangle, and the term "rectangular" encompasses the adjective "square". As used herein, when a second number is "within Y %" of a first number, it means that the second number is at least (1−Y/100) times the first number and the second number is at most (1+Y/100) times the first number. As used herein, the term "or" should be interpreted as "and/or", such that, for example, "A or B" means any one of "A" or "B" or "A and B".

The terms "processing circuit" or "means for processing" are used herein to mean any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured, i.e., hard-wired, to perform that function, or by more general purpose hardware, such as a CPU, configured to execute instructions stored in a non-transitory storage medium. A processing circuit may be fabricated on a single printed circuit board (PCB) or distributed over several interconnected PCBs. A processing circuit may contain other processing circuits; for example a processing circuit may include two processing circuits, an FPGA and a CPU, interconnected on a PCB.

As used herein, when a method (e.g., an adjustment) or a first quantity (e.g., a first variable) is referred to as being "based on" a second quantity (e.g., a second variable) it means that the second quantity is an input to the method or influences the first quantity, e.g., the second quantity may be an input (e.g., the only input, or one of several inputs) to a function that calculates the first quantity, or the first quantity may be equal to the second quantity, or the first quantity may be the same as (e.g., stored at the same location or locations in memory as) the second quantity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" or "between 1.0 and 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a system and method for transistor parameter estimation have been specifically described and illustrated herein, many modifications and variations will be apparent to those skilled in the art. Accordingly, it is to be understood that a system and method for transistor parameter estimation constructed according to principles of this disclosure may be embodied other than as specifically described herein. The invention is also defined in the following claims, and equivalents thereof.

What is claimed is:

1. A method for setting a first compensation coefficient for a transistor, the method comprising:

determining a plurality of measured transistor currents, each at a respective one of a plurality of transistor control voltages;

setting the first compensation coefficient based on the measured transistor currents and the transistor control voltages;

setting a second compensation coefficient; and adjusting a voltage applied to a gate of the transistor based on the first compensation coefficient and on the second compensation coefficient, the voltage corresponding to a color value, wherein:

the setting of the first compensation coefficient and the second compensation coefficient comprises estimating a parameter of the transistor;

the first compensation coefficient is a multiplicative compensation coefficient;

the second compensation coefficient is an additive compensation coefficient; and the setting of the multiplicative compensation coefficient and the additive compensation coefficient comprises estimating a plurality of parameters of the transistor.

2. The method of claim 1, wherein the plurality of parameters includes an alpha, a threshold voltage, and a mobility.

3. The method of claim 2, wherein the estimating of the plurality of parameters of the transistor comprises solving two equations for two parameters, the two parameters being the alpha and the threshold voltage.

4. The method of claim 3, wherein each of the two equations depends only, of the parameters of the transistor, on the alpha and the threshold voltage.

5. The method of claim 3, wherein $$\frac{(Vgs_4 - V_{th})^{\alpha} - (Vgs_2 - V_{th})^{\alpha}}{(Vgs_2 - V_{th})^{\alpha} - (Vgs_1 - V_{th})^{\alpha}}$$

has a value within 50% of $$\frac{I_4 - I_2}{I_2 - I_1}$$

wherein:

$I_1$ is a first current of the plurality of measured transistor currents, $I_2$ is a second current of the plurality of measured transistor currents, $I_3$ is a third current of the plurality of measured transistor currents, $I_4$ is a fourth current of the plurality of measured transistor currents, $Vgs_1$ is a transistor control voltage, of the plurality of transistor control voltages, corresponding to the first current, $Vgs_2$ is a transistor control voltage, of the plurality of transistor control voltages, corresponding to the second current, $Vgs_3$ is a transistor control voltage, of the plurality of transistor control voltages, corresponding to the third current, $Vgs_4$ is a transistor control voltage, of the plurality of transistor control voltages, corresponding to the fourth current, $V_{th}$ is the threshold voltage, and $\alpha$ is the alpha.

6. The method of claim 3, wherein $$\frac{(Vgs_2 - V_{th})^{\alpha}}{(Vgs_1 - V_{th})^{\alpha}}$$

has a value within 50% of $$\frac{I_2}{I_1}$$

wherein:

$I_1$ is a first current of the plurality of measured transistor currents, $I_2$ is a second current of the plurality of measured transistor currents, $Vgs_1$ is a transistor control voltage, of the plurality of transistor control voltages, corresponding to the first current, $Vgs_2$ is a transistor control voltage, of the plurality of transistor control voltages, corresponding to the second current, $V_{th}$ is the threshold voltage, and $\alpha$ is the alpha.

7. The method of claim 3, wherein the solving comprises finding an approximate numerical solution for the alpha and the threshold voltage, the approximate numerical solution minimizing a measure of error in the extent to which the two equations are satisfied.

8. The method of claim 3, further comprising solving for the mobility with a least squares fit, based on the alpha and the threshold voltage.

9. The method of claim 8, wherein the parameters further include a bias current.

10. The method of claim 9, further comprising solving for the bias current with a least squares fit, based on the alpha, the threshold voltage, and the mobility.

11. The method of claim 2, wherein the estimating of the plurality of parameters of the transistor comprises solving one equation for the threshold voltage, wherein the equation depends only, of the parameters of the transistor, on the threshold voltage.

12. The method of claim 11, wherein $$\frac{\log\left[\frac{(Vgs_4 - V_{th})}{(Vgs_3 - V_{th})}\right]}{\log\left[\frac{(Vgs_2 - V_{th})}{(Vgs_1 - V_{th})}\right]}$$

has a value within 50% of $$\frac{\log\left[\frac{I_4}{I_3}\right]}{\log\left[\frac{I_2}{I_1}\right]}$$

wherein:

$I_1$ is a first current of the plurality of measured transistor currents, $I_2$ is a second current of the plurality of measured transistor currents, $I_3$ is a third current of the plurality of measured transistor currents, $I_4$ is a fourth current of the plurality of measured transistor currents, $Vgs_1$ is a transistor control voltage, of the plurality of transistor control voltages, corresponding to the first current, $Vgs_2$ is a transistor control voltage, of the plurality of transistor control voltages, corresponding to the second current, $Vgs_3$ is a transistor control voltage, of the plurality of transistor control voltages, corresponding to the third current, $Vgs_4$ is a transistor control voltage, of the plurality of transistor control voltages, corresponding to the fourth current, and $V_{th}$ is the threshold voltage.

13. The method of claim 2, further comprising setting the additive compensation coefficient to a value within 20% of a value corresponding to an effective threshold voltage of zero.

14. The method of claim 13, further comprising setting the multiplicative compensation coefficient to a value within 20% of a value corresponding to an effective mobility equal to a reference mobility.

15. The method of claim 1, wherein the first compensation coefficient is a multiplicative compensation coefficient and the second compensation coefficient is an additive compensation coefficient, and the method further comprises:

setting the voltage applied to the gate based on:

the multiplicative compensation coefficient, the additive compensation coefficient, and the color value, measuring a difference between:

a current driven by the transistor, and a reference current; and adjusting the multiplicative compensation coefficient and the additive compensation coefficient based on the difference.

16. A system comprising:

a processing circuit;

a power source;

a light emitting device; and a transistor, connected between the power source and the light emitting device, the processing circuit being configured to:

determine a plurality of measured transistor currents, each at a respective one of a plurality of transistor control voltages;

set a first compensation coefficient based on the measured transistor currents and the transistor control voltages; and set a second compensation coefficient, wherein:

the setting of the first compensation coefficient and the second compensation coefficient comprises estimating a parameter of the transistor;

the first compensation coefficient is a multiplicative compensation coefficient;

the second compensation coefficient is an additive compensation coefficient;

the setting of the multiplicative compensation coefficient and the additive compensation coefficient comprises estimating a plurality of parameters of the transistor; and the parameters include an alpha, a threshold voltage, and a mobility.

17. The system of claim 16, wherein the estimating of the plurality of parameters of the transistor comprises solving two equations for two parameters, the two parameters being the alpha and the threshold voltage, wherein each of the two equations depends only, of the parameters of the transistor, on the alpha and the threshold voltage.

18. A system comprising:

means for processing;

a power source;

a light emitting device; and a transistor, connected between the power source and the light emitting device, the means for processing being configured to:

determine a plurality of measured transistor currents, each at a respective one of a plurality of transistor control voltages;

set a first compensation coefficient based on the measured transistor currents and the transistor control voltages; and set a second compensation coefficient, wherein:

the setting of the first compensation coefficient and the second compensation coefficient comprises estimating a parameter of the transistor;

the first compensation coefficient is a multiplicative compensation coefficient;

the second compensation coefficient is an additive compensation coefficient;

the setting of the multiplicative compensation coefficient and the additive compensation coefficient comprises estimating a plurality of parameters of the transistor; and the parameters include an alpha, a threshold voltage, and a mobility.

* * * * *